US005247890A

United States Patent [19]

Mihirogi

[11] Patent Number: 5,247,890

[45] Date of Patent: Sep. 28, 1993

[54] GIRDER TYPE SWITCH TRACK

[75] Inventor: Kiyoshi Mihirogi, Tokyo, Japan

[73] Assignee: HSST Corporation, Tokyo, Japan

[21] Appl. No.: 814,334

[22] PCT Filed: Aug. 23, 1991

[86] PCT No.: PCT/JP91/01123

§ 371 Date: Mar. 5, 1992

§ 102(e) Date: May 3, 1992

[87] PCT Pub. No.: WO92/03616

PCT Pub. Date: May 3, 1992

[30] Foreign Application Priority Data

Aug. 28, 1990 [JP] Japan ..... 2-225499

[51] Int. Cl.[5] ..... E01B 25/00

[52] U.S. Cl. ..... 104/130

[58] Field of Search ..... 104/130, 130.1, 100, 104/102, 96, 103

[56] References Cited

U.S. PATENT DOCUMENTS

| | | | |
|---|---|---|---|
| 4,016,818 | 4/1977 | Ellzey | 104/130 |
| 4,109,584 | 8/1978 | Mihirogi | 104/130 |

FOREIGN PATENT DOCUMENTS

| | | | |
|---|---|---|---|
| 0611600 | 12/1960 | Canada | 104/130 |
| 1070201 | 12/1959 | Fed. Rep. of Germany | 104/130 |
| 0031822 | 1/1962 | Finland | 104/130 |
| 0550053 | 3/1955 | Italy | 104/130 |
| 0602935 | 2/1958 | Italy | 104/130 |
| 4328245 | 11/1968 | Japan . | |
| 0070505 | 6/1979 | Japan | 104/130 |
| 0136006 | 10/1979 | Japan | 104/130.1 |
| 0083620 | 6/1980 | Japan | 104/130.1 |
| 6030801 | 10/1981 | Japan . | |
| 62-185919 | 8/1987 | Japan . | |
| 3-28401 | 2/1991 | Japan . | |
| 0048951 | 1/1992 | Japan | 104/130 |
| 0096881 | 8/1957 | Norway | 104/130 |
| 0181409 | 3/1956 | Sweden | 104/130 |

*Primary Examiner*—Mark T. Le

*Attorney, Agent, or Firm*—Jordan and Hamburg

[57] ABSTRACT

A switch track for switching a girder type track between a plurality of stationary tracks comprises a movable track girder including a drive girder and at least one driven girder. One end of the driven girder is rotatably supported at a predetermined point located on the ground, and the other end of the driven girder is connected to the drive girder. The drive girder is driven by a drive arrangement to pivot at one side thereof adjacent to the driven girder, around an imaginary center common to both of its ends, in order to enable it is move between connecting points of respective main tracks. The driven girder is moved only by driving the drive girder, such that the movable track girder is switched between connecting paths to the respective main tracks.

9 Claims, 4 Drawing Sheets

GIRDER TYPE SWITCH TRACK

DESCRIPTION

1. Field of the Invention

The present invention relates to a girder type switch track for use in a branching point of a girder type track for guiding a car such as a magnetic levitating type linear motor car or a monorail car.

2. Background of the Invention

As a girder type track for guiding a vehicle, one for supporting and guiding the monorail car is well known.

A known switch track for use in a switch portion of such girder type track comprises a girder portion disposed between a stationary main track and a plurality of stationary other tracks. The girder portion is turnable at its end adjacent to the main track so that the other end can be connected to any of the other tracks In such girder type switch track, in order to obtain a sufficient deflection of the track with using a single such girder portion, the latter should be long enough to smoothen a turning of a car guided thereby. Further, when such girder portion is turned around the one end thereof, an angle of the girder portion with respect to the main track becomes large, so that the car can not be guided smoothly In order to solve this problem, it has been proposed to constitute a switch track with a plurality of girder portions mutually turnably connected to each other to form an articulated curve so that the car is guided smoothly along the curve.

FIG. 5 shows an example of a conventional articulated switch track 53 which is used to connect a stationary main track 51 of a girder type track to either of two other main tracks 52*a* and 52*b* thereof. The switch track 53 includes a plurality (four in the illustrated example) of girder portions 53*a*, 53*b*, 53*c* and 53*d*. The first girder portion 53*a* is turnably connected at one end thereof to an end of the main track 51 by means of a pin 54. The second to fourth girder portions 53*b*–53*d* are mutually turnably connected to form a series connection. Each of the girder portions 53*a* to 53*d* is driven by respective drive means. The drive means may be a crank mechanism having a swingable crank arm. For example, a crank arm 50 of a crank mechanism 55 is engaged with a longitudinal groove formed in the first girder portion 53*a* such that the latter is switched between a position shown by a solid line and a position shown by a chain line with rotation of the crank arm 56. Similarly, the second girder portion 53*b* is driven by a crank arm 58 of a crank means 57, the third girder portion 53*c* is driven by a crank arm 60 of a crank means 50 and the fourth girder portion 53*d* is driven by a crank arm 62 of a crank means 61. The respective crank means 55, 57, 59 and 61 may be driven in symchronism with each other by a single connecting rod 64 which is in turn driven by an electric motor 63. The first girder portion 53*a* is turned around the pin 54 by a predetermined angle with respect to the main track 51, the second girder portion 53*b* is turned by a predetermined angle with respect to the first girder portion 53*a*. Similarly, the third and fourth girder portions 53*c* and 53*d* are turned, respectively. Thus, the main track 51 is connected switchingly to either the other main track 52*a* or 52*b*.

In this conventional switch track, there are provided gaps between the fourth girder portion 53*d* and the other main tracks 52*a*, 52*b* in view of thermal expansion of track. Further, in order to avoid collision of the fourth girder portion 53*d* with any of the other main girder tracks when the switch track is turned, the gaps provided in between the fourth track portion 53*d* and the other main tracks 52*a* and 52*b* must be large enough, which may cause a smooth guiding of the car to be difficult. Further, due to the necessity of moving the girder portions by means of the respective drive means, an overall facility therefor becomes large and expensive.

SUMMARY OF THE INVENTION

Accordingly, it is an object of the present invention to solve these problems inherent to the conventional art by providing a girder type switch track having a simple structure and being capable of smoothing the guiding of a car to any of other main tracks.

Another object of the present invention is to provide a simple and inexpensive switch/guide apparatus for making a gently curved track in a branching point.

A further object of the present invention is to minimize gaps necessary in between stationary tracks and a switch track as well as in between a plurality of movable track portions.

A still further object of the present invention is to simplify the processing of loads, including a braking force and a driving force, on the car in a running direction thereof.

Another object of the present invention is to prevent an excessive load in an unusual case when switching/-guiding is done.

In order to achieve these objects, a switch track for switching a girder type track between a plurality of stationary tracks, according to the present invention, comprises a movable track girder including a drive girder and at least one driven girder having one end rotatably supported at a predetermined point located on ground and the other end connected to the drive girder or driven girder through a connecting means, such as a link. The connecting means is capable of transmitting a movement of the drive girder or driven girder in a direction orthogonal to a longitudinal axis of the movable track girder to the driven girder. The drive girder is driven by a drive means to turn at one side thereof adjacent to the driven girder around an imaginary center to thereby switch between connecting points to the respective main tracks. Thus, by driving only the drive girder, the driven girder or girders follow a movement of the drive girder to complete the intended switching of the girder track.

In the present invention, the drive girder of the girder type switch track switches the main track between the other main tracks because it seems to be turned on the imaginary center by means of the drive means. To the end portion of the drive girder on the side of the imaginary center, the driven girder is connected through the connecting means such as a link. A movement of the drive girder in the direction orthogonal to the axis thereof is transmitted to the driven girder to turn the latter around the predetermined point set on ground. This movement of the driven girder is further transmitted by a link to a next driven girder, if any, to rotate the latter around its own rotation center. The same movement may be achieved for each of subsequest driven girders, if necessary. Thus, when the drive girder is driven, the series connected driven girders are driven thereby to provide an articulated, smooth path from the main track to either of the other main tracks. It is, of course, possible to connect the main track to another main track straightly by the switch track girder with its drive girder, if the latter track is on an extension of the main track.

DESCRIPTION OF THE PREFERRED EMBODIMENTS

The present invention is described in detail with reference to the drawings.

Figure 1:
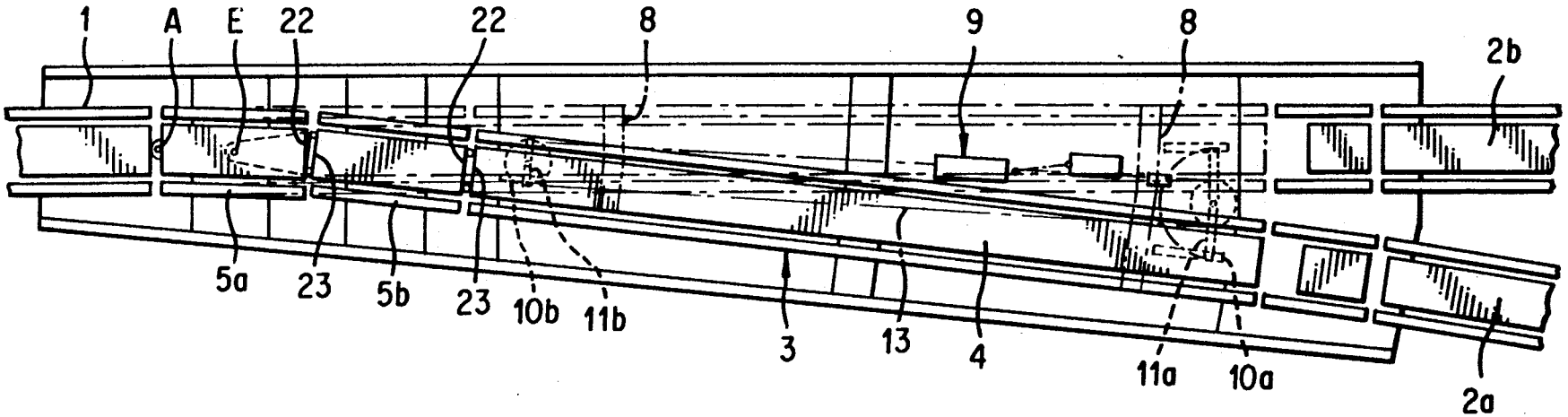
FIG. 1 is a plan view of a girder type switch track according to an embodiment of the present invention.

In FIG. 1, a girder type switch track 3 is provided between a main track 1 of a girder type track and a plurality of other main tracks thereof. In the illustrated case, the second main track 2*a* and the third main track 2*b* are provided. By turning the girder type switch track 3, the first main track 1 is selectively connected to either the second main track 2*a* or the third main track 2*b*. By connecting the first main track 1 to the second main track 2*a*, the first path is formed, while the second path is formed by connecting the first main track 1 to the third main track 2*b*.

The girder type switch track S includes a movable track girder which is composed of a drive girder 4 and at least one driven girder. In the illustrated case, however, the first and second driven girders 5*a* and 5*b* are provided. Such a movable track girder having the drive girder 4 and the driven girders 5*a* and 5*b* is arranged at the position where the first and second paths are formed in order to be gently curved paths, but if circumstances require, either of them forms a straight path. In FIG. 1, at the first path, the drive girder 4 and the driven girders 5*a* and 5*b* form a curved path and, at the second path, they form a straight path. The respective girders 4, 5*a* and 5*b* may be provided with wheels to make their movement smooth.

The driven girders 5*a* and 5*b* are turnable around fulcrums fixedly set between the first path shown by continuous lines and the second path shown by chain double-dashed lines, respectively. The first driven girder 5*a* adjacent to the first main track 1 is turnably supported by fulcrum A set on the first main track 1. The fulcrum A is turnably connected to the first main track 1 (not shown in detail and a conventional mechanism is adopted therefor.

The second driven girder 5*b* is rotatably supported by fulcrum E set on the ground. The fulcrum E may be constituted similarly to the fulcrum A.

The drive girder 4 is turned like being swung on an imaginary center H set in between its positions in the first and second paths.

The drive girder and the driven girders are moved along a guide member provided on the ground. Such a guide member for the drive girder may be constituted with a plurality of rails 8 and wheels (not shown) provided on the drive girder 4 and rollingly guided on the rails 8. The guide member for the driven girders may be constituted similarly.

In order to support a longitudinal load to the drive girder, that is, the driving or braking force of a vehicle moving on the girder, the above-mentioned wheels and guide member can be used. Alternatively, a rotatable rod which may exist between the imaginary center H and the end portion of the drive girder near the second driven girder 5*b* can be used.

Figure 2:
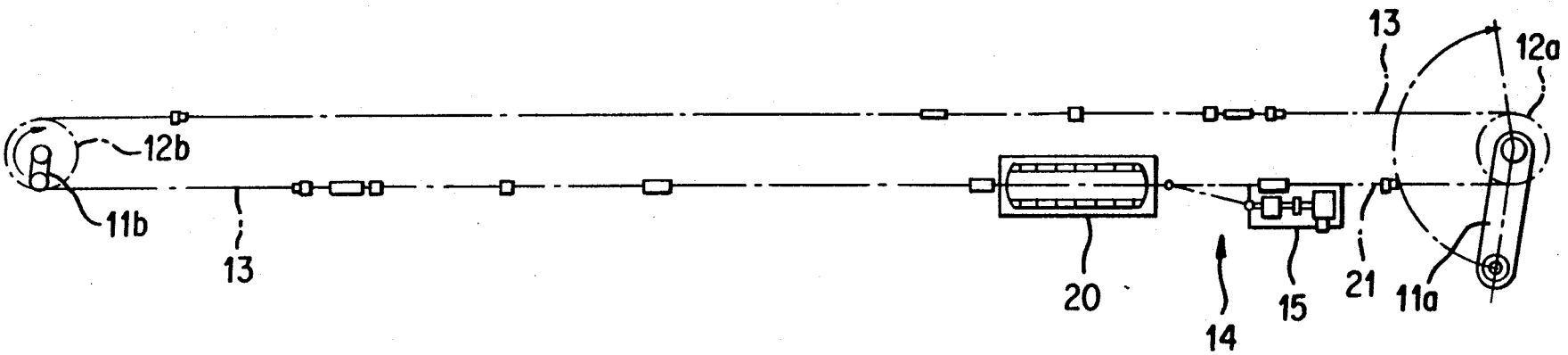
FIG. 2 is a plan view of a drive means for driving a drive girder.
Figure 3:
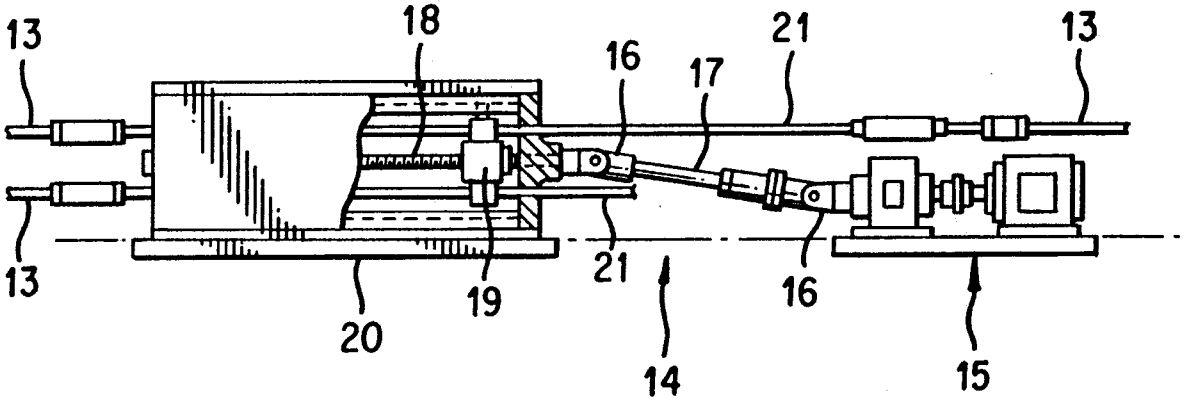
FIG. 3 is a front view of a ball-screw device.

The drive device 9 may be constituted with crank arms 11*a* and 11*b* respectively engaged with longitudinal grooves 10*a* and 10*b* formed in both end portions of the drive girder 4, sprocket wheels 12*a* and 12*b* fixed respectively to the crank arms 11*a* and 11*b* as shown in FIG. 2, a chain 13 stretched on the sprocket wheels 12*a* and 12*b* and a ball-screw device 14 for reciprocating the chain 13. As shown in FIG. 3, the ball-screw device 14 includes a drive portion 15, a screw shaft 18 connected to the drive portion 15 through a universal joint 16 and a connecting rod 17, a ball-nut 19 screwed into the screw shaft 18 and a casing 20 for reciprocably supporting the ball-nut 19. A plurality of such devices 14 may be provided for emergency purpose. The chain 13 is fixed to the ball-nut 19 through a connecting rod 21. The ball-nut 19 is moved by rotating the screw shaft 18 by the drive portion 15. Therefore, the chain 13 is moved and the crank arms 11*a* and 11*b* are rotated in synchronism therewith. With the rotation of the crank arms 11*a* and 11*b*, the drive girder 4 is moved along the rails 8, resulting in a substantial rotation around the imaginary center H. The drive device 9 may be any of other mechanisms such as a hydraulic cylinder mechanism, link mechanism, etc. Further, application of moving force to the drive girder 4 is not limited to two points as shown. Such force may be applied thereto at a single center point thereof.

An end of the drive girder 4 is connected to an end of the second driven girder 5*b* which is located on the opposite side to the fulcrum E through a connecting member 22. The other end of the second driven girder 5*b*, that is, the fulcrum E-side end is connected to an end of the first driven girder 5*a* through another connecting member 22. This end is situated on the opposite side to the fulcrum A. The connecting members 22 serve to transmit movements in directions trasverse to the axes of the drive girder 4 and the second driven girder 5*b* respectively to the second and first driven girders 5*b* and 5*a* while buffering axial movements by absorbing them. For example, the simplest connecting member may be a link lever 23. The link lever 23 is connected at each end to the drive girder 4 or the second driven girder 5*b* and another link lever 23 is connected at each end to the second driven girder 5*b* or the first driven girder 5*a*. In order to minimize relative deviation of axis-lines of the movable girders adjacent each other, it is preferable to arrange the link levers 23 such that they extend in moving directions of the movable girders 4, 5*a* and 5*b*, respectively.

The rotation center, that is, the imaginary center H and the fulcrums A and E points or fulcrums of the respective movable girders 4, 5*a* and 5*b* are set such that a gently curved path is formed by the girders 4, 5*a* and 5*b* with gaps therebetween as small as possible. In order to facilitate the understanding of setting of them, as seen in FIGS. 4*a* to 4*e* the movable girders 4, 5*a* and 5*b* are depicted by single center lines, respectively, length of the drive girder 4 by $l_1$, that of the driven girder 5*a*, 5*b* by $l_2$, and rotation angles of the drive girder 4, the first driven girder 5*a* and the second driven girder 5*b* by $\theta_1$, $\theta_2$ and $\theta_3$, respectively. Although, in the illustrated case, the driven girders 5a and 5b have the same length, these can be made different. It is theoretically preferable that the fulcrum A of the first driven girder 5a adjacent to the first main track 1 is set in one edge portion of the first driven girder 5a. In such case, the other end B of the first driven girder 5a moves to a point B' by rotation of the girder 5a around the fulcrum A. Although it is theoretically preferable that one end of the second driven girder 5b moves along the same path as that of the end B of the first driven girder 5a in view of minimizing the gap therebetween, it is impossible to make their movements identical since the rotation centers thereof are different from each other. Accordingly, in the second arrangement, one end of the second driven girder 5b should be positioned at the points B and B' which are positions of the end of the first driven girder 5a when switched between the first and second paths. In order to realize this, the position of the fulcrum E of the second driven girder 5b is set on a line passing through a center point F between the points B and B' and the point A which is the fulcrum of the first driven girder 5a.

The rotation centers necessary to make the curve formed by the girders gentle is calculated with conditions $l_1=19.7$ m, $l_2=4.2$ m, $\theta_1=7.2°$, $\theta_2=2.4°$ and $\theta_3=4.8°$.

First, the position of the fulcrum E which is the rotation center of the second driven girder 5b is calculated. In FIG. 4b, depicting distance between B and F as a, that between E and F as b, that between A and F as c and that between A and E as d, the followings are obtained:

$a=4.2 \sin 1.2°=0.0879582$ $b=a/\tan 2.4°=2.0986191$ $c=a/\tan 1.2°=4.1990806$ $d=c-b=2.1004615$ Depicting a cross point between a linear line $\overline{AB}$ and a perpendicular from the point E to the line $\overline{AB}$ by G, length of a linear line $\overline{EG}$ by e and a distance between A and G by f, the followings are obtained:

$e=d \sin 1.2°=0.0439887 \approx 0.044$ m $f=d \cos 1.2°=2.1000008 \approx 2.100$ m From the values of f and e, the position of the fulcrum E of the second driven girder 5b is set.

Next, a rotation center H of the end portion of the drive girder 4 which is adjacent to the second driven girder 5b, that is, the end portion on the side of C and C', is obtained such that its end coincides at the points C and C' with the second driven girder 5b rotating around the fulcrum E.

Figure 4A:
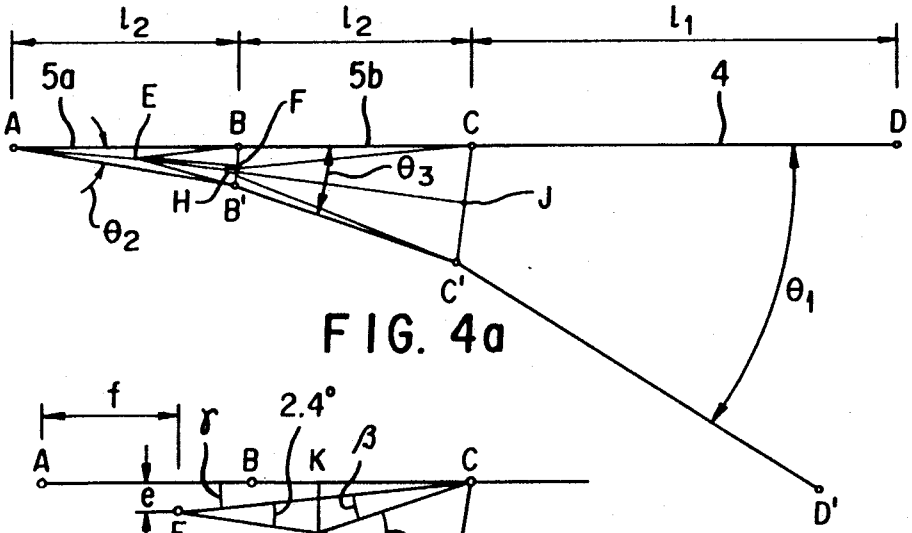
FIGS. 4*a* to 4*d* show sequential calculation of fulcrums, an imaginary center and standard points therefor.
Figure 4B:
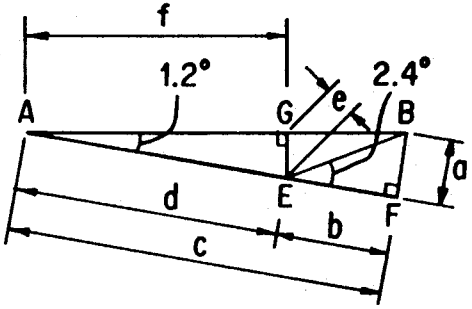
Figure 4C:
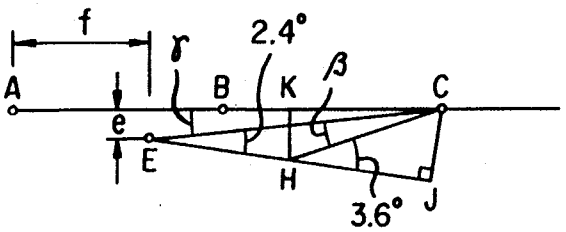

In FIGS. 4a and 4c, a line connecting a center point J between the points C and C' to the point E is a bisector passing through a center of an arc CC' having a center point at the point E. Therefore, the rotation center H of the end portion of the drive girder 4 on the CC' side exists on the bisector. Further, since a rotation angle of this end portion of the drive girder 4 from the point C around the point H is 7.2°, the position of the point H is determined from the bisector angle 3.6°.

In FIG. 4c, assuming, $<HCE=\beta$ and $<ECA=\gamma$, $$\begin{aligned}
\beta &= 3.6° - 2.4° = 1.2° \\
\gamma &= \tan^{-1}\{e/(8.4 - f)\} \\
&= \tan^{-1}\{0.0439887/(8.4 - 2.1000008)\} \\
&= 0.4000518
\end{aligned}$$

-continued $$\begin{aligned}
\overline{EC} &= g = \{(8.4 - f)^2 + e^2\}^{\frac{1}{2}} \\
&= 6.3001528 \\
\overline{JC} &= h = 6.3001528 \sin 2.4° \\
&= 0.2638230 \\
\overline{HC} &= j = h/\sin 3.6° = 4.2016375
\end{aligned}$$

Depicting a cross point of the perpendicular from the point H to the straight line $\overline{AC}$ and the line $\overline{AC}$ by K, $$\begin{aligned}
\overline{HK} &= k = j \sin(\beta + \gamma) \\
&= j \sin(1.2 + 0.4000518) \\
&= 0.1173204 \approx 0.117 \\
\overline{KC} &= m = j \cos(\beta + \gamma) \\
&= j \cos(1.2 + 0.4000518) \\
&= 4.1999992 \approx 4.200 = BC
\end{aligned}$$

The rotation center H of the end portion of the drive girder 4 adjacent to the second driven girder 5b can be set from k and m on the basis of the point C. In the described example, the point H is eccentric from the point B by k. As a matter of course, a rotation center of the end portion of the drive girder 4 on the DD' side is also H, and this is the imaginary center of the drive girder 4.

Just for reference, the point C is rotatively moved to the point C, by fulcruming the imaginary center H by 7.2°. A line passing through this point C' with an angle of 7.2° with respect to the straight line $\overline{AD}$ represents a position of the drive girder 4 after moved. Depicting a cross point of an extension of this line and the line $\overline{AD}$ by Ho (this is the standard point with respect to installment), the end portion C of the drive girder 4 on the second drive girder side, that is, the point K is moved Ko after rotated, as shown in FIG. 4d.

Figure 4D:
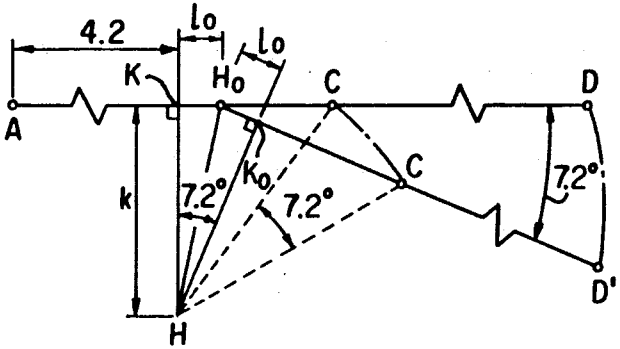

$\overline{KHo}=lo=\overline{HoKo}$ shown in FIG. 4d is calculated. Since $<KHHo=<HoHKo=3.6°$, $$\begin{aligned}
lo &= \tan 3.6° \times k \\
&= 0.00738 \approx 0.007\ m
\end{aligned}$$

Figure 4E:
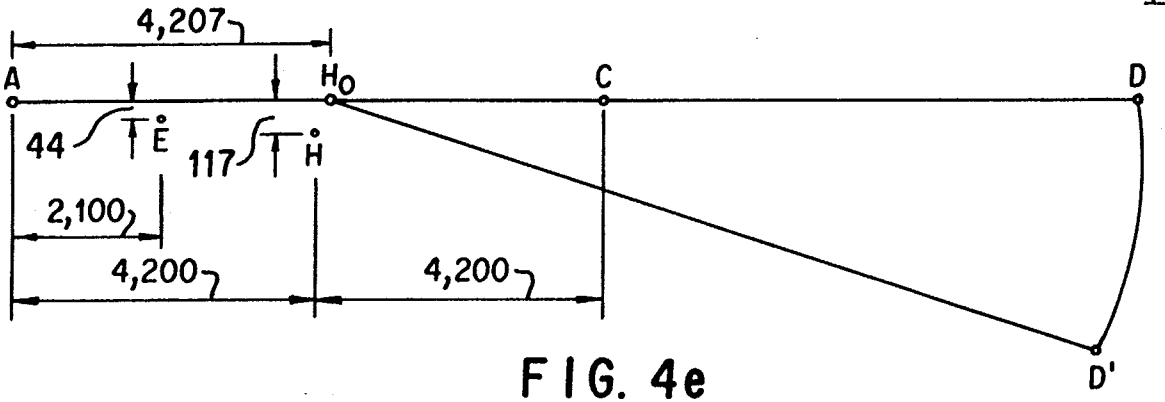
FIG. 4*e* shows all of the fulcrums, the imaginary center and the standard points thus calculated.
Figure 5:
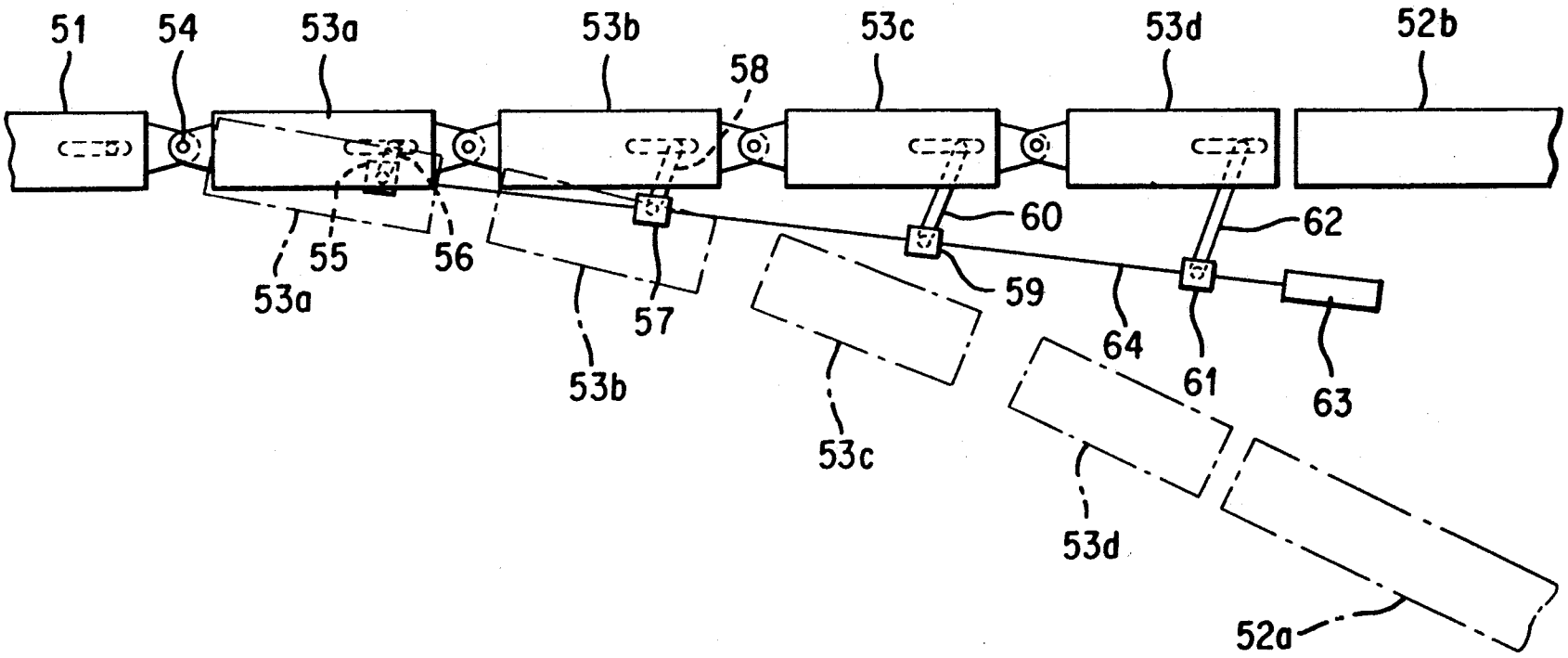
FIG. 5 shows an example of a conventional girder type switch track.

Therefore, the positions of the imaginary center, the fulcrums and the standard point of the respective girders 4, 5a and 5b become as shown in FIG. 4e.

When the drive girder 4 is guided by the guide members 8 such that the girder 4 rotates around the imaginary center H, the driven girders 5a and 5b are rotated automatically around their fulcrums A and E by the connecting members, providing a gently curved path or straight path, together with the drive girder.

Enlarging or reducing the rotation angles of the girders gradually in order, it is possible to form smooth and gently curved track.

What is claimed is:

1. A switch track for switching a girder type track between a plurality of station tracks comprising:

a movable track girder including a drive girder and at least one driven girder, one end of said driven girder being rotatably supported at a predetermined fulcrum point located on ground, the other end of said driven girder being connected to said one end of said drive girder through a connecting means, said connecting means being mounted to transmit movement of said drive girder in a direction orthogonal to a longitudinal axis of said movable track girder to said driven girder, and drive means connected to pivot said drive girder to turn at one side thereof adjacent to said driven girder around an imaginary center to thereby move said drive girder between connecting points at which said movable track is aligned with the respective station tracks, both ends of said drive girder being pivoted only about said imaginary center, said driven girder being mounted to be driven only by said drive girder, to thereby switch said movable track girder between connecting paths to said respective station tracks.

2. The switch track claimed in claim 1, wherein facing ends of said driven girder and drive girder, which are rotated around said fulcrum point and said imaginary center respectively, are mounted so that said facing ends transitorily separate and take substantially the same positions with respect to one another at each of said connecting points.

3. The switch track claimed in claim 1 or 2, comprising means for reciprocating said drive girder by said drive means around said imaginary center and a guide member for guiding said drive girder during said reciprocation.

4. The switch track claimed in claim 1 or 2, wherein said fulcrum point and said imaginary center of said girders are eccentric with respect on one another.

5. The switch track claimed in claim 1 or 2, wherein said drive means comprises a chain extending between a pair of sprocket wheels, separate cranks having different lengths coupled to said sprocket wheels, said cranks being connected to move different parts of said drive girder, and a ball-screw connected to drive said chain.

6. The switch track claimed in claim 1 or 2, wherein said connecting means comprises means for absorbing distortion at both ends of said drive girder due to positional difference of said fulcrum point and said imaginary center of the girders adjacent to each other.

7. The switch track of claim 1 wherein said fulcrum point is a point that is different from said imaginary center and wherein said connecting means is connected to transmit movement to said driven girder only in a direction orthogonal to said longitudinal axis.

8. A switch track for switching a girder type track between a plurality of station tracks comprising:

a movable track girder including a drive girder and first and second driven girders, one end of each of said driven girders being rotatably supported at a separate predetermined fixed fulcrum point, the other end of said first driven girder being coupled to said second driven girder by a first connecting means and the other end of said second driven girder being connected to said drive girder by a second connecting means, said first and second connecting means being mounted to transmit movement of said second driven girder and said drive girder respectively in a direction orthogonal to a longitudinal axis of said movable track girder to said first and second driven girders, respectively, and drive means connected to pivot said drive girder to turn at one side thereof adjacent to said second driven girder around an imaginary center to thereby move between connecting points at which said movable track girder is aligned with the respective station tracks, both end of said drive girder being pivoted only about said imaginary center, said first and second driven girders being mounted to be driven only by movement of said drive girder, to thereby switch said movable track girder between connecting paths to said respective station tracks.

9. The switch track of claim 8 wherein said separate fixed points are different from said imaginary center and wherein said second connecting means is connected to drive said second driven girder only in said orthogonal direction.

* * * * *